US010819062B2

(12) United States Patent
Hsu

(10) Patent No.: US 10,819,062 B2
(45) Date of Patent: Oct. 27, 2020

(54) WATERPROOF CONNECTOR

(71) Applicant: SMMMPLUS ELECTRONIC TECHNOLOGY CO.,LTD., Dongguan (CN)

(72) Inventor: Ching-Jen Hsu, Dongguan (CN)

(73) Assignee: SMMMPLUS ELECTRONIC TECHNOLOGY CO., LTD., Dongguan (CN)

( * ) Notice: Subject to any disclaimer, the term of this patent is extended or adjusted under 35 U.S.C. 154(b) by 0 days.

(21) Appl. No.: 16/688,467

(22) Filed: Nov. 19, 2019

(65) Prior Publication Data

US 2020/0259292 A1 Aug. 13, 2020

Related U.S. Application Data

(60) Provisional application No. 62/803,894, filed on Feb. 11, 2019.

(51) Int. Cl.

| | |
|---|---|
| ***H01R 13/52*** | (2006.01) |
| ***H01R 13/6581*** | (2011.01) |
| *H01R 107/00* | (2006.01) |
| *H01R 24/60* | (2011.01) |
| *H01R 24/70* | (2011.01) |
| *H01R 13/516* | (2006.01) |

(Continued)

(52) U.S. Cl.

CPC ..... *H01R 13/5219* (2013.01); *H01R 13/5202* (2013.01); *H01R 13/5216* (2013.01); *H01R 13/6581* (2013.01); *H01R 12/725* (2013.01); *H01R 13/516* (2013.01); *H01R 24/60* (2013.01); *H01R 24/66* (2013.01); *H01R 24/70* (2013.01); *H01R 2107/00* (2013.01)

(58) Field of Classification Search

CPC ..... H01R 13/5202; H01R 13/5219; H01R 24/66; H01R 24/70; H01R 13/516; H01R 12/725

See application file for complete search history.

(56) References Cited

U.S. PATENT DOCUMENTS

| | | | | |
|---|---|---|---|---|
| 7,922,535 | B1 * | 4/2011 | Jiang | H01R 13/6581 439/607.35 |
| 9,391,391 | B2 * | 7/2016 | Chien | H01R 13/5202 |
| 9,742,098 | B2 * | 8/2017 | Zhao | H01R 13/6581 |

(Continued)

FOREIGN PATENT DOCUMENTS

| | | | | |
|---|---|---|---|---|
| CN | 106356665 A | * | 1/2017 | H01R 13/5202 |

*Primary Examiner* — Tho D Ta
(74) *Attorney, Agent, or Firm* — WPAT, PC

(57) ABSTRACT

The invention discloses a waterproof connector. The waterproof connector includes a shell assembly, the shell assembly includes a metallic shell and a first sealing member, the metallic shell includes a top surface, a bottom surface and two lateral surfaces, a cavity is defined by the top surface, the bottom surface and the lateral surfaces, the first sealing member is sleeved on the peripheral of the metallic shell; a conductive assembly, the conductive assembly is received in the cavity, the conductive assembly includes an insulative housing, a plurality of contact terminals and a second sealing member, the insulative housing includes a base portion and a tongue extending forwardly from the base portion, the contact terminals are insert molded with the insulative housing, the second sealing member is assembled onto the insulative housing.

15 Claims, 6 Drawing Sheets

(51) Int. Cl.
*H01R 12/72* (2011.01)
*H01R 24/66* (2011.01)

(56) References Cited

U.S. PATENT DOCUMENTS

| | | | | |
|---|---|---|---|---|
| 9,761,988 | B1 * | 9/2017 | Lin | H01R 13/5216 |
| 9,899,779 | B1 * | 2/2018 | Lin | H01R 13/5202 |
| 10,355,394 | B2 * | 7/2019 | Zhang | H01R 12/716 |
| 2016/0033198 | A1 * | 2/2016 | Hsiao | H01R 24/60 439/485 |
| 2017/0338585 | A1 * | 11/2017 | Wang | H01R 13/5202 |
| 2019/0027859 | A1 * | 1/2019 | Tada | H01R 43/005 |

* cited by examiner

WATERPROOF CONNECTOR

CROSS REFERENCE TO PRIORITY APPLICATIONS

This application hereby claims the benefit of U.S. Provisional Patent Application No. 62/803,894, filed Feb. 11, 2019 at the United States Patent and Trademark Office, which is hereby incorporated by reference in its entirety.

FIELD OF THE INVENTION

The invention pertains to the field of connectors, particularly to a waterproof connector.

BACKGROUND OF THE INVENTION

At present, some electronic devices need to be exposed to a humid environment. In order to prevent moisture from entering the electronic device and affecting electrical connections, the electrical connector located outside the electronic device itself needs to have a waterproof function. The conventional connector, such as a Type C connector, has a gap with the outer casing of the electronic device, thus moisture may enter the electronic device via the waterproof connector when the outer casing of the electronic device contacts the moisture, thereby damaging the electronic device and bringing problems during use. After plugging and unplugging the electrical connector multiple times, the components of the connector are prone to loosening and falling off, so the addition of a sealing ring alone does not guarantee a good waterproof function. In addition, the water-proof function is also required between the electrical connector and the casing of the electronic equipment.

Therefore, there is a need to invent a new waterproof connector to solve the above-mentioned problems.

SUMMARY OF THE INVENTION

The purpose of the invention is to solve the problems in the prior art.

In accordance with an aspect of the embodiment, there is provided a waterproof connector. The waterproof connector includes a shell assembly, the shell assembly includes a metallic shell and a first sealing member, the metallic shell includes a top surface, a bottom surface and two lateral surfaces, a cavity is defined by the top surface, the bottom surface and the lateral surfaces, the first sealing member is sleeved on the peripheral of the metallic shell; a conductive assembly, the conductive assembly is received in the cavity, the conductive assembly includes an insulative housing, a pluralities of contact terminals and a second sealing member, the insulative housing includes a base portion and a tongue extending forwardly from the base portion, the contact terminals are insert molded with the insulative housing, the second sealing member is assembled onto the insulative housing.

BRIEF DESCRIPTION OF THE DRAWINGS

The invention will be described with reference to the accompanying drawings. These and/or other aspects and advantages of the invention will become apparent and more readily appreciated from the following description of the embodiments, taken in conjunction with the accompanying drawings.

DETAILED DESCRIPTION OF THE INVENTION

The invention will be further described below in details with reference to the figures and embodiments.

Figure 1:
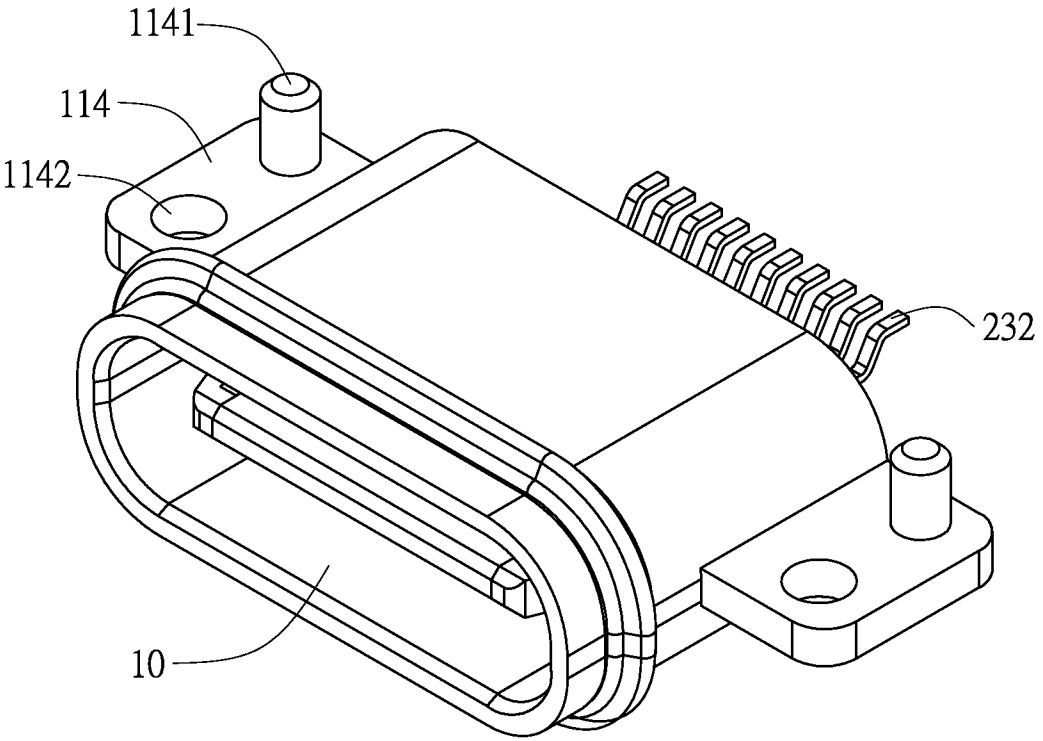
FIG. 1 is a perspective view of the water-proof connector according to one embodiment of the present invention.
Figure 2:
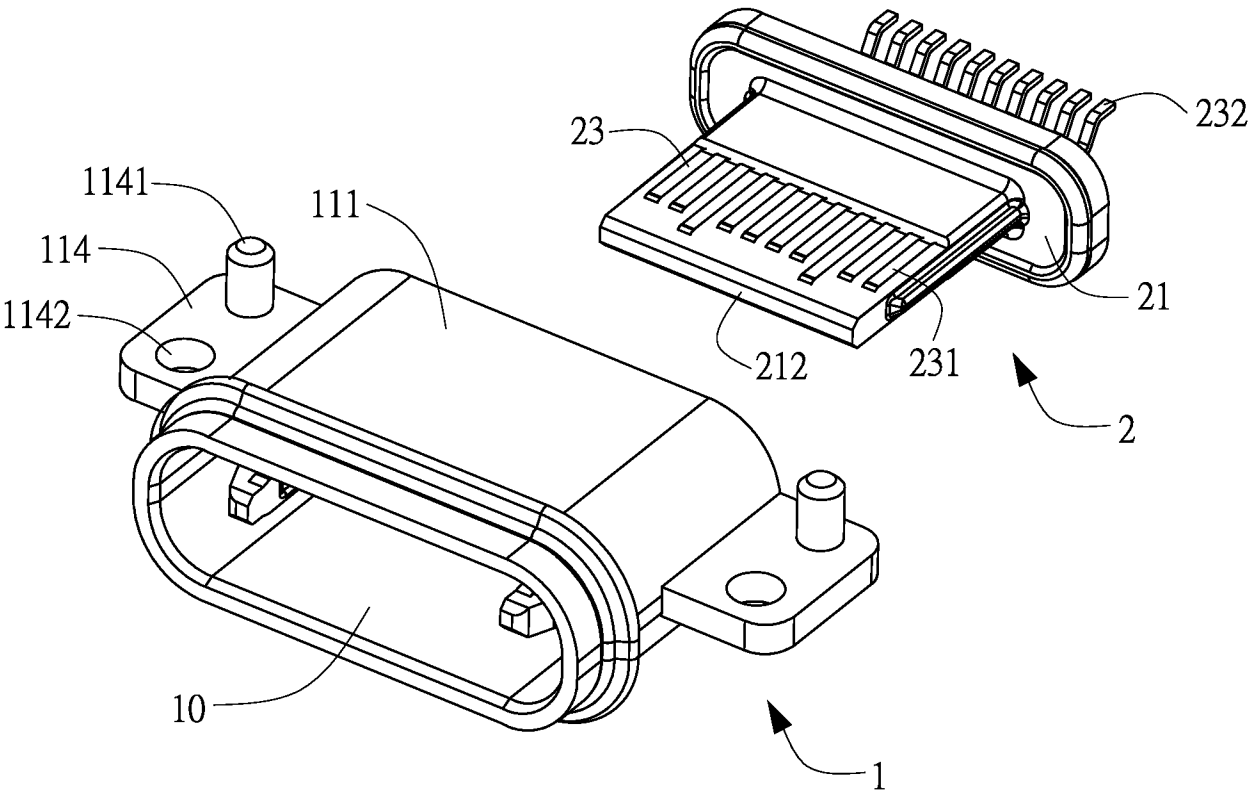
FIG. 2 is a partially exploded view of the water-proof connector according to one embodiment of the present invention.
Figure 3:
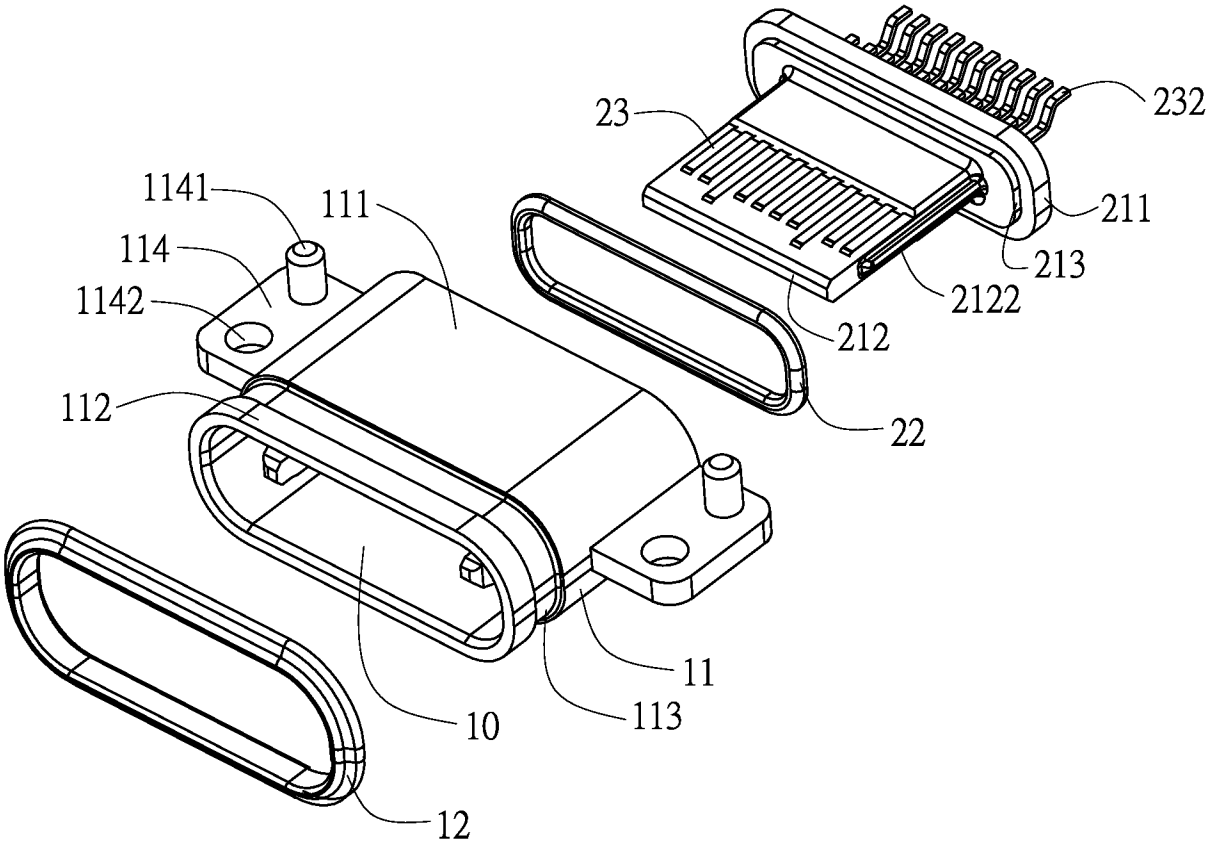
FIG. 3 is a further exploded view of the waterproof connector according to one embodiment of the present invention.

Referring generally to FIG. 1 to FIG. 3, the waterproof connector according to the present invention includes a shell assembly 1 and a conductive assembly 2, the shell assembly 1 includes a metallic shell 11 and a first sealing member 12, the conductive assembly 2 includes an insulative housing 21, a plurality of contact terminals 23 and a second sealing member 22.

The metallic shell 11 is seamless and integrally formed of a liquid metal, therefore, the metal shell 11 has enough strength. The metal shell 11 includes a top surface, a bottom surface, two lateral surfaces, and a cavity 10 is defined by interconnecting the top surface, the bottom surface and the lateral surfaces.

A positioning plate 114 is extending from at least one of the two lateral surfaces of the metallic shell 11. In the present embodiment, a pair of the positioning plate 114 are respectively extending from the lateral surfaces of the metallic shell 11. A positioning post 1141 and a positioning hole 1142 are disposed on the positioning plate 114, the positioning hole 1141 is used for fixing the waterproof connector onto a chassis (not shown) via a fixing member (not shown), the positioning post 1142 is used for fixing the waterproof connector onto a printed circuit board (not shown).

The insulative housing 21 includes a base portion 211 and a tongue 212 extending forwardly from the base portion 211, the contact terminals 23 are insert molded with the insulative housing 21, the second sealing member 22 is assembled onto the insulative housing 21. Each of the contact terminals 23 includes a contacting portion 231 and a soldering portion 232 extending from the contacting portion 232, the soldering portion 232 extends beyond the cavity 10.

The first sealing member 12 is sleeved on the peripheral of the metallic shell 11, the metallic shell 12 includes a head portion 112, a main body 111 and a concave portion 113, the main body 111 extends backwardly from the head portion 112, the concave portion 113 is defined between the head portion 112 and the main body 111, the first sealing member 12 is filled in the concave portion 113. The first sealing member 12 covers the outer surface of the metal shell 11 and fills the concave portion 113, thereby increasing the contact area of the first sealing member 12 and the metallic shell 11, so that the connection between the first sealing member 12 and the metallic shell 11 is tight and reliable, and the first sealing member 12 is effectively prevented from loosening or even falling off.

Figure 4:
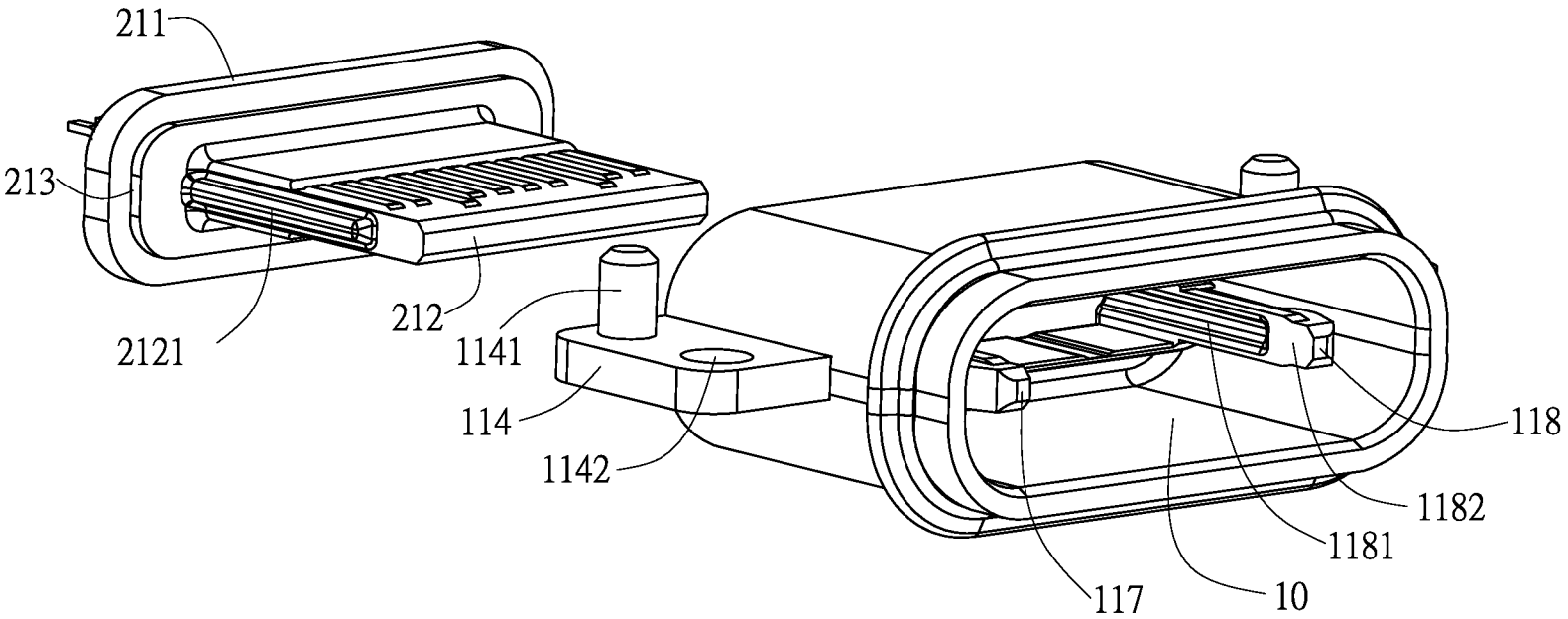
FIG. 4 is a partially exploded view of the water-proof connector viewed from another direction.
Figure 5:
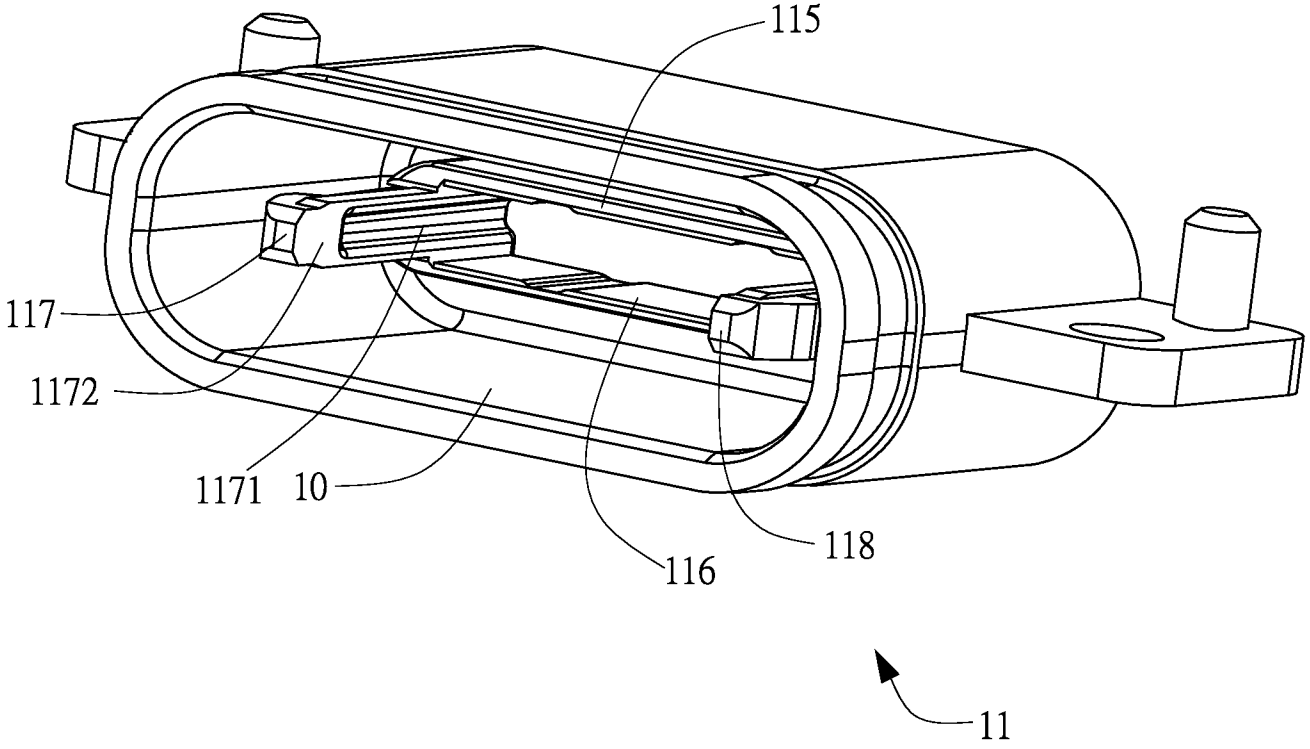
FIG. 5 is a perspective view of the metallic shell of the water-proof connector according to one embodiment of the present invention.
Figure 6:
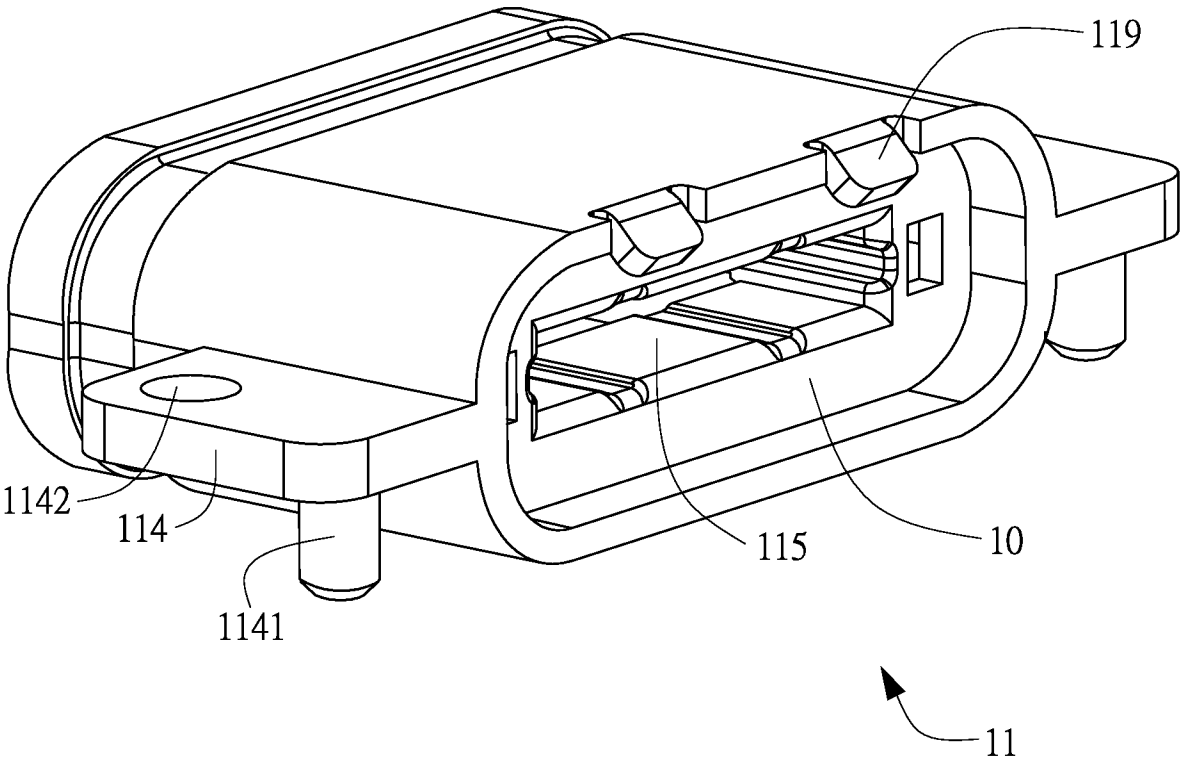
FIG. 6 is another perspective view of the metallic shell of the water-proof connector according to one embodiment of the present invention viewed from another direction.

Referring to FIG. 4 to FIG. 6, a first grounding plate 115 and a second grounding plate 116 extend forwardly from the tail of the metallic shell 11, the first grounding plate 115 and the second grounding plate 116 are located in the cavity 10, the first grounding plate 115 and the second grounding plate 116 are substantially parallel. The first grounding plate 115 extends forwardly to form a first grounding terminal 117, the second grounding plate 116 extends forwardly to form a second grounding terminal 118. The first grounding plate 115, the second grounding plate 116, the first grounding terminal 117, second grounding terminal 118, and the metallic shell 11 are integrally formed in one piece. Therefore, the metallic shell 11, and the first grounding plate 115 and the second grounding plate 116 both have sufficient strength, and the electrical signals are conducted smoothly, and a reliable EMI shielding effect is achieved.

The first grounding terminal 117 is recessed inwardly and away from a lateral side of the tongue 212 to form a first guiding portion 1171, the corresponding lateral side of the tongue 212 protrudes to form a first mating portion 2121, and the first mating portion 2121 is mated with the first guiding portion 1171. The second grounding terminal 118 is recessed inwardly and away from another lateral side of the tongue 212 to form a second guiding portion 1181, the corresponding another lateral side of the tongue 212 protrudes to form a second mating portion 2122, and the second mating portion 2122 is mated with the second guiding portion 1181. The grounding terminals and the tongue of the waterproof connector according to the present invention are assembled via the mating portion and the guiding portion, the dimensions are more easily controlled, and the strength of the waterproof connector of the present invention is enhanced.

A first leaning portion 1172 is defined on the front of the first grounding terminal 117, the first mating portion 2121 leans against the first leaning portion 1172, a second leaning portion 1182 is defined on the front of the second grounding terminal 117, the second mating portion 2122 leans against the second leaning portion 1182. Therefore, a more stable cooperation between the tongue 212 and the metallic shell 11 is achieved.

Two limiting portions 119 are extending from the tail of the metallic shell 11, the limiting portion 119 leans against the tail of the insulative housing 21 to prevent the withdrawal of the conductive assembly 2.

The insulative housing 21 further includes a connecting portion 213 defined between the tongue 212 and the base portion 211, the circumference of the connecting portion 213 is smaller than that of the base portion 211, and the circumference of the connecting portion 213 is larger than that of the tongue 212. The second sealing member 22 is annular and sleeved on a periphery of the connecting portion 213, and the second sealing member 22 is substantially flush with the base portion 211.

In the embodiment, the first sealing member 12 and the second sealing member 22 are both annular, and formed by liquid silicone molding or silicone injection molding. In other embodiments, the first sealing member 12 and the second sealing member 22 is injection molded from rubber. Part of the first sealing member 12 exceeds the top surface, the bottom surface and the lateral surfaces of the metallic shell 11.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A waterproof connector, comprising:

a shell assembly, the shell assembly including a metallic shell and a first sealing member, the metallic shell including a top surface, a bottom surface and two lateral surfaces, a cavity being defined by the top surface, the bottom surface and the two lateral surfaces, the first sealing member being sleeved on the peripheral of the metallic shell;

a conductive assembly, the conductive assembly being received in the cavity, the conductive assembly including an insulative housing, a plurality of contact terminals and a second sealing member, the insulative housing including a base portion and a tongue extending forwardly from the base portion, the contact terminals being insert molded with the insulative housing, the second sealing member being assembled onto the insulative housing;

a first grounding plate and a second grounding plate extend forwardly from a tail of the metallic shell, the first grounding plate and the second grounding plate are located in the cavity, the first grounding plate extends forwardly to form a first grounding terminal, the second grounding plate extends forwardly to form a second grounding terminal; the first grounding terminal is recessed inwardly and away from a lateral side of the tongue to form a first guiding portion, the lateral side of the tongue protrudes to form a first mating portion, and the first mating portion is mated with the first guiding portion.

2. The waterproof connector as defined in claim 1, wherein the metallic shell is seamless, the metallic shell includes a head portion, a main body and a concave portion, the main body extends backwardly from the head portion, the concave portion is defined between the head portion and the main body, the first sealing member is filled in the concave portion.

3. The waterproof connector as defined in claim 1, wherein a positioning plate is extending from at least one of the two lateral surfaces of the metallic shell, a positioning post and a positioning hole are disposed on the positioning plate, the positioning hole is used for fixing the waterproof connector onto a chassis via a fixing member, the positioning post is used for fixing the waterproof connector onto a printed circuit board.

4. The waterproof connector as defined in claim 1, wherein two limiting portions are extending from two tails of the metallic shell, the limiting portion leans against a tail of the insulative housing to prevent the withdrawal of the conductive assembly.

5. The waterproof connector as defined in claim 1, wherein the second grounding terminal is recessed inwardly and away from another lateral side of the tongue to form a second guiding portion, the another lateral side of the tongue protrudes to form a second mating portion, and the second mating portion is mated with the second guiding portion.

6. The waterproof connector as defined in claim 1, wherein the first sealing member is annular, and part of the first sealing member exceeds the top surface, the bottom surface and the two lateral surfaces of the metallic shell.

7. The waterproof connector as defined in claim 1, wherein the insulative housing further includes a connecting portion defined between the tongue and the base portion, the second sealing member is annular and sleeved on a periphery of the connecting portion, and the second sealing member is substantially flush with the base portion.

8. A waterproof connector, comprising:

a shell assembly, the shell assembly including a metallic shell and a first sealing member, a cavity being formed by the metallic shell;

a conductive assembly, the conductive assembly being received in the cavity, the conductive assembly including an insulative housing, a plurality of contact terminals and a second sealing member, the insulative housing including a base portion and a tongue extending forwardly from the base portion, the contact terminals being insert molded with the insulative housing, the second sealing member being assembled onto the insulative housing, wherein, a first grounding plate and a second grounding plate extend forwardly from a tail of the metallic shell, the first grounding plate and the second grounding plate are located in the cavity, the first grounding plate extends forwardly to form a first grounding terminal, the second grounding plate extends forwardly to form a second grounding terminal;

the first grounding plate and the second grounding plate are connected by the first grounding terminal and the second grounding terminal, and the first grounding terminal and the second grounding terminal are respectively located on two lateral sides of the tongue; the first grounding terminal is recessed inwardly and away from a lateral side of the tongue to form a first guiding portion, the lateral side of the tongue protrudes to form a first mating portion, and the first mating portion is mated with the first guiding portion.

9. The waterproof connector as defined in claim 8, wherein the first grounding plate, the second grounding plate, the first grounding terminal, second grounding terminal, and the metallic shell are integrally formed in one piece.

10. The waterproof connector as defined in claim 8, wherein the second grounding terminal is recessed inwardly and away from another lateral side of the tongue to form a second guiding portion, the another lateral side of the tongue protrudes to form a second mating portion, and the second mating portion is mated with the second guiding portion.

11. A waterproof connector, comprising:

a metallic shell, the metallic shell including a top surface, a bottom surface and two lateral surfaces, the top surface, the bottom surface and the two lateral surfaces being interconnected to form a cavity;

a first sealing member, the first sealing member being fitted on the periphery of the metallic shell;

an insulative housing, the insulative housing being received in the cavity, the insulative housing including a base portion and a tongue extending forwardly from the base portion, the insulative housing further including a connecting portion located between the tongue and the base portion;

a plurality of contact terminals, the contact terminals being insert molded with the insulative housing, each of the contact terminals including a contacting portion and a soldering portion extending from the contacting portion, the soldering portion extends beyond the cavity;

a second sealing member, the second sealing member being assembled onto the insulative housing;

a first grounding plate and a second grounding plate extend forwardly from a tail of the metallic shell, the first grounding plate and the second grounding plate are located in the cavity, the first grounding plate extends forwardly to form a first grounding terminal, the second grounding plate extends forwardly to form a second grounding terminal, the first grounding plate, the second grounding plate, the first grounding terminal, second grounding terminal, and the metallic shell are integrally formed in one piece; the first grounding terminal is recessed inwardly and away from a lateral side of the tongue to form a first guiding portion, the lateral side of the tongue protrudes to form a first mating portion, and the first mating portion is mated with the first guiding portion.

12. The waterproof connector as defined in claim 11, wherein the metallic shell is seamless, the metallic shell includes a head portion, a main body and a concave portion, the concave portion is defined between the head portion and the main body.

13. The waterproof connector as defined in claim 12, wherein the first sealing member is annular, and part of the first sealing member exceeds the top surface, the bottom surface and the lateral surfaces of the metallic shell.

14. The waterproof connector as defined in claim 12, wherein the circumference of the connecting portion is smaller than that of the base portion, and the circumference of the connecting portion is larger than that of the tongue.

15. The waterproof connector as defined in claim 14, wherein the second sealing member is annular and sleeved on a periphery of the connecting portion, and the second sealing member is substantially flush with the base portion.

* * * * *